United States Patent [19]

Tuttrup

[11] 4,244,265

[45] Jan. 13, 1981

[54] DRUM APPARATUS

[76] Inventor: Gene J. Tuttrup, 516 C Olive Pl., Honolulu, Hi. 96818

[21] Appl. No.: 945,032

[22] Filed: Sep. 22, 1978

[51] Int. Cl.[3] ..... G10D 13/02

[52] U.S. Cl. ..... 84/411 R; 84/411 A; 84/419; D17/22

[58] Field of Search ..... 84/411–420; D17/22

[56] References Cited

U.S. PATENT DOCUMENTS

| | | | |
|---|---|---|---|
| 283,352 | 8/1883 | McCord | 84/419 X |
| 804,347 | 11/1905 | Schultz | 84/413 |
| 1,312,771 | 8/1919 | Vogeler | 84/419 |
| 1,356,193 | 10/1920 | Danly | 84/419 |
| 1,980,876 | 11/1934 | Peters | 84/411 R |
| 3,021,743 | 2/1962 | Ludwig | 84/419 |
| 4,048,895 | 9/1977 | May | 84/411 A |
| 4,112,807 | 9/1978 | Quibell | 84/411 R |

FOREIGN PATENT DOCUMENTS

| | | | |
|---|---|---|---|
| 87629 | 3/1922 | Austria | 84/419 |
| 695192 | 12/1930 | France | 84/419 |
| 430279 | 2/1948 | Italy | 84/419 |

*Primary Examiner*—Lawrence R. Franklin
*Attorney, Agent, or Firm*—James Creighton Wray

[57] ABSTRACT

Drums have downward and integrally continuously joined truncated conical walls of 3° and then 30° angles. A drum skin is stretched across a large open end and a brace is connected to a smaller open end. A slide moves downward on the brace as controlled by a screw jack, and cables stretched by the slide across idler pulleys on the body pull down a rim to tighten the drum head and tune the drum.

11 Claims, 8 Drawing Figures

FIG. 1
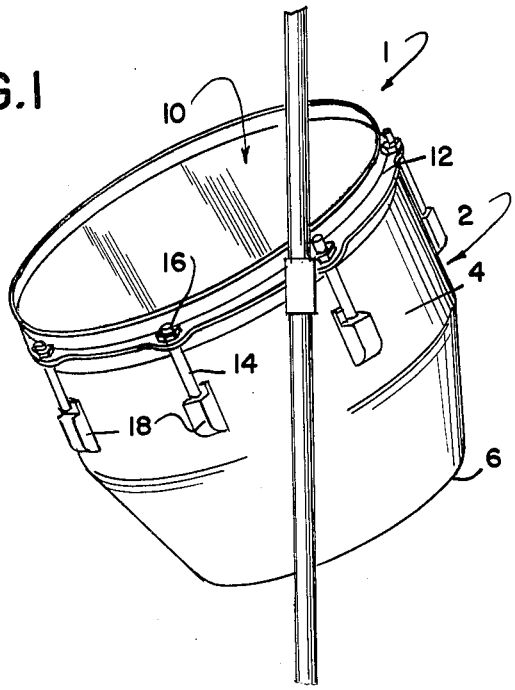
FIG. 2
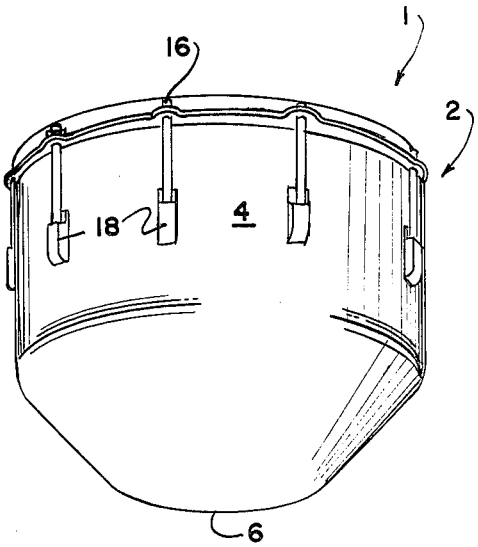
FIG. 5
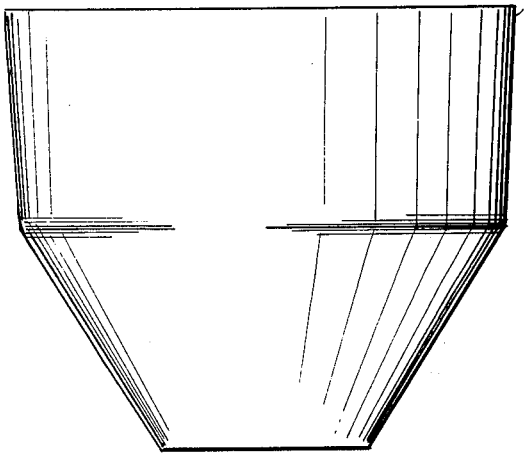
FIG. 6
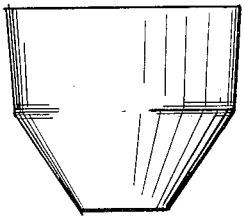
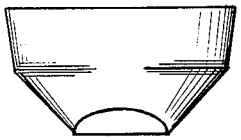
FIG. 8
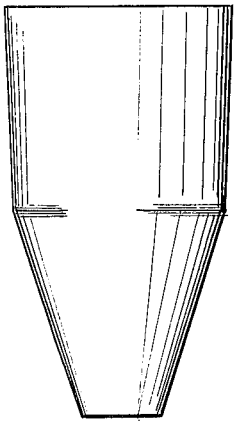
FIG. 7

FIG. 4
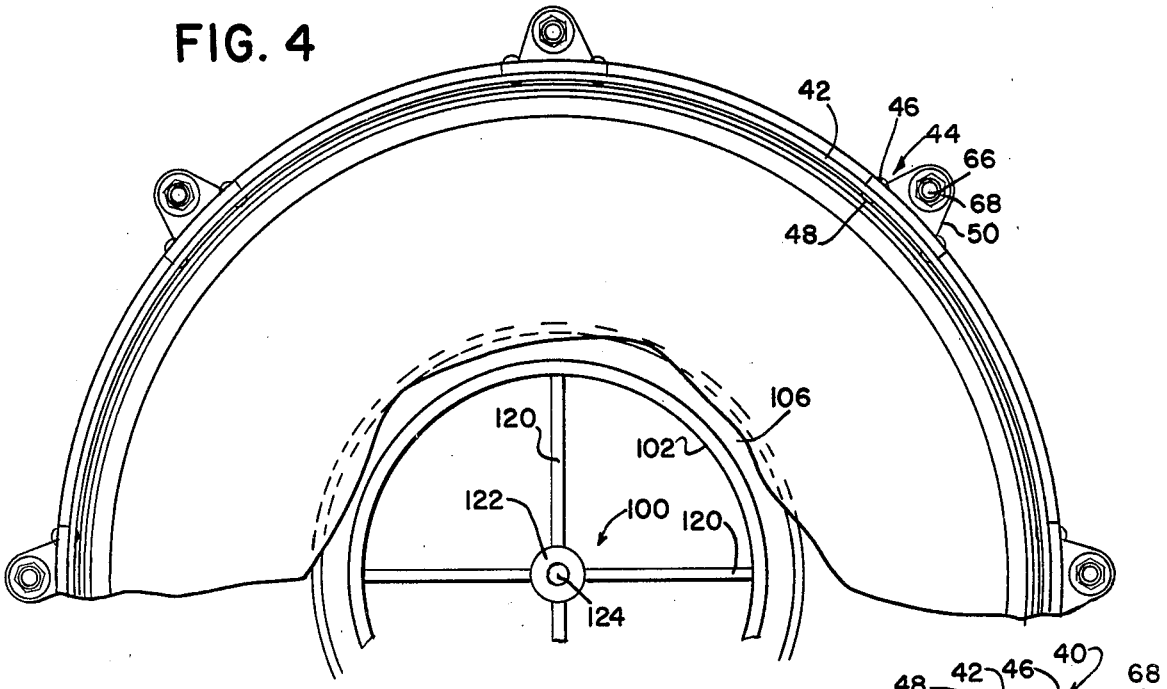
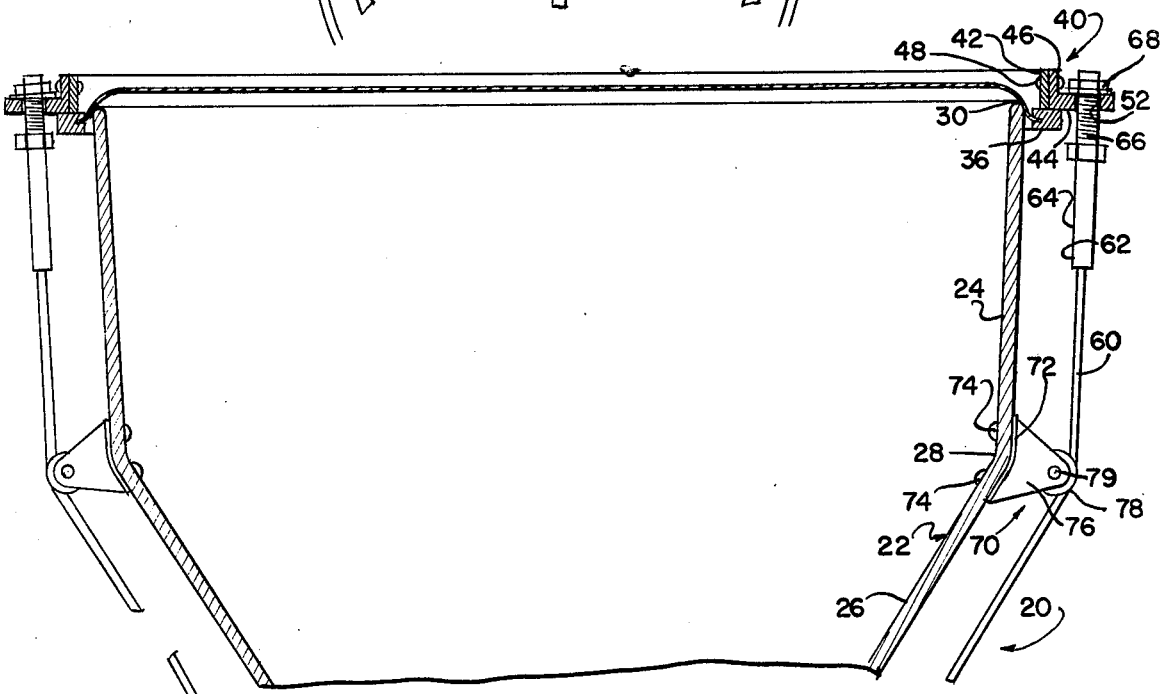
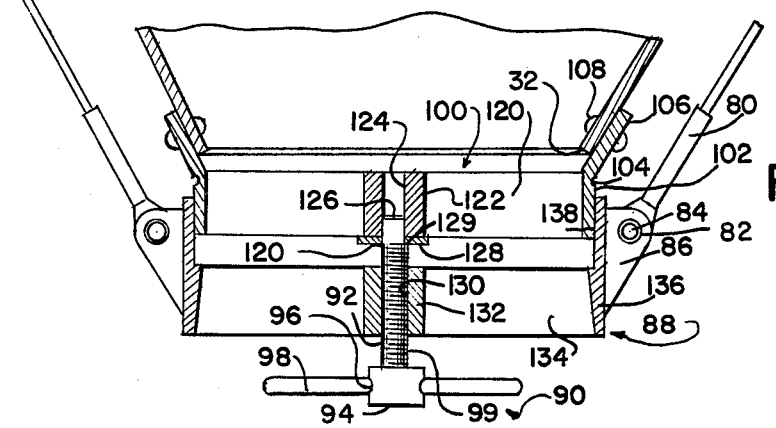
FIG. 3

DRUM APPARATUS

BACKGROUND OF THE INVENTION

A number of different types of percussion instruments in the forms of drums and timpani are available for producing different sounds. Various means of tuning the drums and timpani are available. Drums usually have cylindrical bodies with drum skins at one or both ends. Timpani have curved closed bodies with drum skins stretched over single open ends. Drums are conventionally tuned by shortening or lengthening rods which interconnect rings which stretch the drum skins over open ends of the drums. Timpani are conventionally tuned by devices which concurrently stretch the skin.

PRIOR ART

Relevant United States and foreign patents are found in the United States Patent Office, classified in Class 84, Music, subclasses 304, 411, 411A, 413, 421, 422, 430, 432, 442, 454, 458, and Digest 18.

Examples of the patents found therein are U.S. Pat. Nos. 2,617,325; 2,074,193; 2,173,443; 2,495,451; 3,185,013; 3,215,019; 3,215,021; 3,439,573; 4,048,895; 229,776 and U.S. Pat. No. Des. and British Pat. Nos. 592979 and 815297, and German Pat. No 510976.

No patent describes the present invention.

German Pat. No. 510976 shows a drum having an inverted cone shaped drum body attached to a floor stand. No circular opening is shown at the smaller end of the drum body.

U.S. Pat. No. Des. 229,776 shows a base kettle for a musical drum having a slanting cylindrical drum body and a closed curved end.

British Pat. No. 592979 shows a unitary tensioning device having a manually operable tuning knob. The knob is connected to a series of cables connected to the drum skin. Turning the knob exerts a pulling force on the cables thus tuning the drum skin.

British Pat. No. 815297 shows a tensioning device for kettle drums having a chain connected to a plurality of individual tensioning handles mounted on sprocket wheels of each handle. Turning a single handle causes an equal turning of the other handles thus tensioning the drum skin.

U.S. Pat. No. 4,048,895 shows an adjustable pitch drum having a single lever tuning device which rotates the drum head to vary the tension of the drum skin on the head, thereby altering the pitch of the drum.

U.S. Pat. No. 3,439,573 shows a drum tuning device having two turning screws which simultaneously tightens the tension of a drum skin.

U.S. Pat. No. 3,215,021 shows a variable sound drum having a variable length drum body for altering the sound.

U.S. Pat. No. 2,074,193 shows a snare drum requiring individual tensioning of screws 15 in conjunction with a restraining ring on a drum head.

U.S. Pat. No. 3,185,013 shows a drum having knee cup supports pressed outwardly against tensioning strings. As the player presses his knees against the knee supports to hold the drum, he may alter the tone of the drum by squeezing his knees harder against the knee supports thereby varying the tension on the tensioning strings.

U.S. Pat. No. 2,173,443 shows a unitary tensioning device having a sprocket belt connected to a series of sprocket gears. A rotatable shaft is connected to a hand wheel. Turning the hand wheel rotates a plurality of shaft sections toward each other to adjust tension on the drum skin to tune the drum.

U.S. Pat. No. 3,215,019 shows a banjo head tightener having a rotating hub which winds cords attached to a drum skin thereby altering the tension of the skin.

U.S. Pat. No. 2,495,451 shows a tuning apparatus for drums having a rubber cup pressed upwardly against a drum skin and connected to an idler wheel assembly which exerts pressure on the drum skin by pressing the rubber cup upwardly against the skin.

U.S. Pat. No. 2,617,325 shows a beater for a drum which prevents the skin from becoming damp, a condition which permits the skin to lose its vibratory resonance.

Although many drum and timpani bodies and tuning devices are known, none produces the sound and tuning of that sound which was the object of the quest resulting in the present invention.

No patents have a cylindrical drum body having an inward slanting open end opposite from the drum skin. No patents show a turning apparatus having a single screw mounted across the opening of the slanted end which simultaneously tightens a plurality of cables attached to a drum skin.

SUMMARY OF THE INVENTION

A drum has a drum body with an upper generally cylindrical and slightly inward tapered section and a slower inward sloped section which slants inward to an open circular end opposite from a larger upper drum head opening over which a drum skin is stretched. The drum is tuned by a single wing screw mounted on a telescoping frame across the slanted open end of the drum. A plurality of tension cables attached to the drum skin holding ring run parallel to the surface of the drum body and are attached to the sliding frame. The tension cables are tightened by turning the wing screw, which concurrently stretches the drum skin with an equal force across the drum body.

Drums have downward and integrally continuously joined truncated conical walls of 3° and then 30° angles. A drum skin is stretched across a large open end and a brace is connected to a smaller open end. A slide moves downward on the brace as controlled by a screw jack, and cables stretched by the slide across idler pulleys on the body pull down a rim to tighten the drum head and tune the drum.

OBJECTS OF THE INVENTION

One object of the invention is the provision of a percussion instrument having a drum body with a relatively large first open end, a drum skin stretched across the first open end, an inward sloping sidewall and a second smaller end opposite the first open end.

Another object of the invention is the provision of a drum body having a first section and a second section with walls of varied slopes.

A further object of the invention is the provision of drum bodies with first and second interconnected truncated conical sections.

Another object of the invention is the provision of a drum body with a first upper section having a sidewall which tapers slightly inward.

Another object of the invention is the provision of a drum body having an upper section with a slightly tapering sidewall sloping inward about three degrees from vertical.

Another object of the invention is the provision of a drum body having upper and lower truncated conical sections with the second section sloping inward about thirty degrees from a sidewall of a first section.

A further object of the invention is the provision of a drum with a plurality of cables for stretching the drum skin across an opening.

A further object of the invention is the provision of a drum tensioning device having a wing screw for tightening cables and a plurality of pulleys connected along the sidewall of the drum body for guiding the cables to run parallel to drum body sections.

A further object of the invention is the provision of a drum tensioning device having perpendicular intersecting beams extended across a lower opening and a tensioning screw attached at the intersection of the beams.

These and further and other objects and features of the invention are apparent in the disclosure which includes the above and below specification, the claims and the drawings.

BRIEF DESCRIPTION OF THE DRAWINGS

FIG. 1 shows one form of the invention.

FIG. 2 is a view of the drum shown in FIG. 1.

FIG. 3 shows a preferred form of the drum.

FIG. 4 is a bottom detail of the drum shown in FIG. 3.

FIG. 5 is a schematic representation of a preferred form of the drum.

FIG. 6 is a schematic showing of another form of the drum of the present invention.

FIG. 7 is a schematic representation of a third form of a drum of the present invention.

FIG. 8 is a schematic representation of a fourth form of a drum of the present invention.

DETAILED DESCRIPTION OF THE DRAWINGS

Referring to FIG. 1, a drum of the present invention is generally referred to by the numeral 1. The drum has a body 2 with an upper section 4 and a lower section 6 which slopes inward. A drum head 10 is stretched across the open upper end of body 2 by a ring 12. A plurality of threaded rods 14 extend downward through openings in ring 12. Rods 14 are formed with heads 16 and are similar to bolts. Receivers 18 mounted on body 2 contain fixed threaded nut-like elements. Applying an adjusting wrench to the heads 16 of rods 14 and turning all of the rods substantially the same amount, moves ring 12 and adjusts the tension on head 10, changing the pitch of drum 1.

In the preferred form of the invention shown in FIG. 3, the drum is generally referred to by the numeral 20. Drum body 22 has an upper section 24 and a lower section 26 joined at a continuous intersection 28. Drum 20 has an open upper end 30 and an open smaller lower end 32.

In the preferred form of the invention the upper portion 24 and lower portion 26 are formed as integrally joined truncated conical shells. The upper portion 24 tapers slightly inwardly and the lower portion 26 tapers inwardly in a more pronounced manner.

While lower end 32 is open in the preferred embodiment, lower end 32 may be closed by a membrane or a skin or by other means. When lower end 32 is closed, it is preferred that the position or tautness or both be adjustable, as later will be described.

Referring to the upper end 30 of the drum body, preferably the end is formed with a rounded upper edge of curvilinear, preferably semicircular cross section.

A membrane 34 which is conventionally referred to as a drum skin or a drum head is placed over the open upper end 30 of the drum. The membrane 34 has attached to an outer circular edge thereof a retaining ring 36 which may be bonded to the membrane 34 or integrally formed therewith, or which may take the form of complementary clamping rings or any other means for securely holding the outer edge of the membrane 34.

A tuning ring 40 overlies the retaining ring 36. Tuning ring 40 includes a hoop-like rim 42, and L-shaped lugs 44 with curving backs 46 which fit against the rim 42. Rivets 48 securely hold rim 42 and backs 46 of lugs 44. Horizontal outward extensions 50 of lugs 40 have holes 52 which receive fittings of tuning cables 60. The end fittings 62 on cables 60 have throats 64 which are welded or otherwise joined to the cable ends. Bolt-like extensions 66 fit through holes 52 in lugs 44 and receive nuts 68. Turning the nuts 68 permits relative adjustment of the cables to make all cables pull uniformly on the tuning ring 40.

Near the intersection 28 of the upper portion 24 and the lower portion 26 of drum body 22 are located idler pulley blocks 70. The blocks have double legged T-shaped cross sections with curved bases 72 which closely overlie the curved intersection 28 of the drum body. Rivets 74 connect the bases 72 to drum body 22. Parallel flanges 76 extend outward to hold idler pulleys 78 on pins 79.

The lower end of each cable 60 has permanently attached thereto a fitting 80 having a looped end 82 with a central hole. A pin 84 connects the end to one of plural lugs 86 which extend radially outward from a circular slide 88.

Slide 88 is adjustable telescopically with the lower end of the drum by screw jack 90. Turnscrew 92 has a hub 94 with a hole 96 extending therethrough, in which is permanently positioned, such as by press fitting, a rod 98. Threaded shank 99 moves slide 88 vertically as turnscrew 92 is turned.

Across the bottom opening 32 of drum 20, a brace 100 is fitted. The brace has an annular rim 102 which is scored 104 near its top so that an annular outward sloped lip 106 may be turned outwardly from the rim. The slope of lip 106 is similar to the slope of lower drum body portion 26 so that lip 106 telescopically receives the lower edge of the drum portion 26. Rivets 108 hold the elements assembled. Two perpendicularly intersecting beams 120 extend inward from rim 102, and hub 122 is formed at their intersection. A central opening 124 in the hub receives an unthreaded shank end 126 of the turnscrew 92. A washer 128 supports the shoulder 129 of the turnscrew.

The threaded shank 99 of turnscrew 92 turns in a threaded opening 130 in a central hub portion 132 of slide 88. Perpendicularly intersecting beams 134 support an annular rim 136 which has an inward stepped portion 138 which rides on an outer surface of rim 102 of brace 100.

As the turnscrew 92 is turned clockwise, slide 88 slides downward with respect to brace 100, tensioning cables 60 and tightening drum head 34.

As shown in FIGS. 5, 6, 7, and 8 the drum of the present invention may be constructed of different dimensions with desired tonal effects. The lower end of the drum may be closed as shown in FIGS. 6 and 7 or open as shown in FIG. 8.

In the closed modification a drum skin may be anchored between the parallel lip 106 and the lower end of the drum body 26 described with regard to FIGS. 3 and 4.

When it is desired to tune the closed lower end, the lip 106 may be enlarged to permit relative sliding between lip 106 and the lower end 32 of lower body portion 26. The upper edge of lip 106 may rest against a retaining ring of a drum skin which encloses the lower end 32 so that tightening the turnscrew 92 concurrently pulls downward on cables 60 and pushes upward on brace 102 to tighten both upper and lower skins.

In another modification of the invention, the shank of turnscrew 92 may have a double-ended thread with a follower hub bearing against a center of a drum skin covering opening 32 so that turning the screw 92 will advance a nut-like follower toward the drum skin tightening the lower drum skin.

Some of the dimensions which produce desired tonal qualities are described in the following chart.

TABLE OF SIZES

A = Ordering size
B = Actual size of diameter of the rim of the shell
C = Length from top to middle and middle to bottom
D = Angle from top to middle
E = Angle from middle to bottom
F = Thickness

| A | B | C | D | E | F |
|---|---|---|---|---|---|
| 6" | 5¾" | 2½" | 87° | 30° | ⅛" |
| 7" | 6¾" | 2¾" | 87° | 30° | ⅛" |
| 8" | 7¾" | 3¼" | 87° | 30° | ⅛" |
| 10" | 9¾" | 4" | 87° | 30° | ⅛" |
| 12" | 11¾" | 4¾" | 87° | 30° | 3/16" |
| 13" | 12¾" | 5¼" | 87° | 30° | 3/16" |
| 14" | 13¾" | 5½" | 87° | 30° | 3/16" |
| 15" | 14¾" | 6¾" | 87° | 30° | 3/16" |
| 16" | 15¾" | 7" | 87° | 30° | 3/16" |
| 18" | 17¾" | 87° | 30° | 3/16" | |
| 20" | 19¾" | 8" | 87° | 30° | ¼" |
| 22" | 21¾" | 8¾" | 87° | 30° | ¼" |

While the invention has been described with reference to specific embodiments, it will be obvious to those skilled in the art that modifications and variations of those embodiments may be made without departing from the scope of the invention. The scope of the invention is defined in the following claims.

What is claimed:

1. A percussion instrument apparatus comprising:

a drum body having a relatively large first open end, means for stretching a drum skin across the first open end, the body having first and second inward sloping sidewall sections, said first sidewall section sloping slightly inward from said first open end and said second sidewall section sloping inward from said first sidewall section at a substantially greater angle than said first sidewall section, each sidewall section being about one half the length of the drum body, and said drum body having a second smaller open end opposite the first open end.

2. The apparatus of claim 1 wherein the stretching means comprises brace means connected to a lower end of the drum body, slide means connected to the brace, moving means connected to the slide means into the brace for moving the slide means with respect to the brace, cables connected to the slide means and ring means connected to the cables for holding the drum skin around the first open end of the drum body wherein ring means mounts the cables parallel to the drum body.

3. The apparatus of claim 2 wherein the tensioning means comprises a wing screw mounted across an end of the drum body and a plurality of pulleys mounted along the sidewall of the drum body for guiding the cables to run parallel to the external length of the drum body.

4. The apparatus of claim 1 wherein the second section comprises a truncated conical section.

5. The apparatus of claim 1 wherein the slightly tapering sidewall of the generally cylindrical first section slopes inward about three degrees from vertical.

6. The apparatus of claim 5 wherein the sidewall of the truncated conical second section slopes inward thirty degrees from the sidewall of the generally cylindrical first section.

7. The apparatus of claim 1 or 6 further comprising tensioning means and means for connecting the tensioning means to the drum body wherein the tensioning means is mounted across the opening of the truncated conical second section for providing downward pulling pressure on the cables.

8. The apparatus of claim 7 wherein the tensioning means comprises a wing screw and a plurality of pulleys connected along the sidewall of the drum body for tightening the cables and for guiding the cables to run parallel along the external length of the drum body respectively.

9. The apparatus of claim 8 wherein means for connecting the tensioning means across an end of the drum body comprises two perpendicularly intersecting beams wherein the tensioning means is attached at the point of intersection.

10. The apparatus of claim 7 wherein means for connecting the tensioning means across the opening of the truncated conical second section comprises two perpendicularly intersecting beams wherein the tensioning means is attached at the point of intersection of the two beams.

11. The apparatus of claim 7 wherein the tensioning means comprises a brace connected to an end of the body opposite the drum skin, a slide means connected to the brace and moving means connected to the slide means and to the brace for moving the slide means with respect to the brace, the cables being attached to the slide means and parallel to the drum body.

* * * * *